US010301809B2

(12) United States Patent
Kitamura et al.

(10) Patent No.: US 10,301,809 B2
(45) Date of Patent: May 28, 2019

(54) FLUSH TOILET

(71) Applicant: TOTO LTD., Kitakyushu-shi, Fukuoka (JP)

(72) Inventors: Masaki Kitamura, Kitakyushu (JP); Satoshi Yamakawa, Kitakyushu (JP); Kazuyoshi Mizoguchi, Kitakyushu (JP); Shu Kashirajima, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 20 days.

(21) Appl. No.: 14/867,817

(22) Filed: Sep. 28, 2015

(65) Prior Publication Data

US 2016/0138255 A1 May 19, 2016

(30) Foreign Application Priority Data

Nov. 14, 2014 (JP) ..... 2014-231637

(51) Int. Cl.
*E03D 11/08* (2006.01)

(52) U.S. Cl.
CPC ..... *E03D 11/08* (2013.01)

(58) Field of Classification Search
CPC ..... E03D 11/08
USPC ..... 4/420
See application file for complete search history.

(56) References Cited

U.S. PATENT DOCUMENTS

2003/0140406 A1 7/2003 Miwa et al.
2005/0166308 A1 8/2005 Miwa et al.
2006/0005310 A1* 1/2006 Nakamura ..... E03D 11/08 4/420
2010/0186158 A1* 7/2010 Morita ..... E03D 11/08 4/420
2012/0284911 A1 11/2012 Kamiya et al.
2013/0047328 A1 2/2013 Yamasaki et al.

FOREIGN PATENT DOCUMENTS

| | | |
|---|---|---|
| CN | 102953421 | 10/2015 |
| EP | 1273726 | 1/2003 |
| JP | 2002097702 | 4/2002 |
| JP | 2012041793 | 3/2012 |
| JP | 2012-202143 A | 10/2012 |
| JP | 2012251379 | 12/2012 |
| JP | 2014-152468 A | 8/2014 |

(Continued)

OTHER PUBLICATIONS

Taiwanese Office Action for Taiwanese Application No. TW 104134203, Completed by the Taiwanese Patent Office, dated Jul. 14, 2016, 6 Pages.

(Continued)

*Primary Examiner* — Christine J Skubinna
(74) *Attorney, Agent, or Firm* — Brooks Kushman P.C.

(57) ABSTRACT

A flush toilet having a bowl portion including a bowl-shaped waste receiving surface and a rim portion wherein the rim portion includes a rim top inside corner portion, and a rim top outside corner portion, and in at least part of the entire perimeter of the rim portion, the rounding of the rim top inside corner portion is formed to be larger than the rounding of the rim top outside corner portion. This rim profile enables the rim portion top surface, the rim top inside corner portion, and the inside wall can be efficiently cleaned.

6 Claims, 5 Drawing Sheets

(56) References Cited

FOREIGN PATENT DOCUMENTS

| | | |
|---|---|---|
| TW | I247838 | 1/2006 |
| WO | 2012026331 | 3/2012 |

OTHER PUBLICATIONS

Extended European Search Report for European Application No. EP 15191970.1, Completed by the European Patent Office, dated Apr. 14, 2016, 9 Pages.

* cited by examiner

FLUSH TOILET

CROSS-REFERENCE TO RELATED APPLICATIONS

This application claims priority to JP application JP 2014-231637 filed on Nov. 14, 2014, the disclosure of which is incorporated in its entirety by reference herein.

TECHNICAL FIELD

The present invention pertains to a flush toilet, and more particularly to a flush toilet for discharging waste by flushing the toilet using flush water supplied from a flush water source.

BACKGROUND

As disclosed in Patent Document 1 (Japan Patent No. 4941796), for example, a water conduit for spouting flush water supplied from a reservoir tank to the bowl portion is formed at the rear top portion of the toilet main body, and a rim portion is formed along the top edge portion of the bowl portion above this water conduit. In this rim portion, the radius of the inside corner portion formed on the inside of the toilet main body and the radius of the outside corner portion formed on the outside of the toilet main body are formed to have approximately the same size, and can be extremely small radii.

SUMMARY

Technical Problem

However, in a conventional flush toilet 101 such as that shown in FIG. 7, when a user cleans the rim portion 116 with the palm Ha of his or her hand H and/or the palm-side portion of fingers Hb, disposed to contact the rim top surface portion 116*c*, the formation of the rim top inside corner portion 116*d* in a relatively small-radius arc (an arc with approximately the same radius as the rim top outside corner portion 116*e*) means that that bending parts of the finger, such as the second joint portion Hc of the finger, cannot be placed in a way which fits the arc of the rim top inside corner portion 116*d*. This resulted in the problem that the rim top surface portion 116*c*, the rim top inside corner portion 116*d*, and the inside perimeter wall surface 116*a* could not be efficiently cleaned.

Also, the problem arose that when a user seeks to clean these surfaces by excessive bending of his or her fingers, it is difficult for the user to impart the force required for cleaning to hand H.

The present invention was therefore undertaken to resolve the above-described problems with the conventional art, and has the object of providing a flush toilet with which, when wiping off the rim portion with the user's own hand placed from the rim portion top surface to the inside wall so as to follow the rounding of the top inside corner portion, the rim portion top surface, the rim top inside corner portion, and the inside wall can be efficiently cleaned, and the user can easily impart a relatively strong force to the entirety of the rim portion to be wiped clean, so that cleaning performance can be improved.

Solution to Problem

To achieve the above object, the present invention is a flush toilet for discharging waste by flushing the toilet with flush water supplied from a flush water source, having: a bowl portion comprising a bowl-shaped waste receiving surface and a rim portion formed above and outside of the waste receiving surface to form the top edge of the toilet; a discharge path for discharging waste, the inlet of which is connected underneath this bowl portion; a spout portion for spouting flush water to the bowl portion and forming a swirling flow; and a water conduit for supplying flush water to the spout portion; wherein the rim portion comprises: a rim top inside corner portion formed between the top surface and the inside wall of the rim portion and a rim top outside corner portion formed between the top surface and the outside wall of the rim portion; and whereby in at least part of the entire perimeter of the rim portion, the rounding of the rim top inside corner portion is formed to be larger than the rounding of the rim top outside corner portion.

In the invention thus constituted, in at least part of the entire perimeter of the rim portion, the rounding of the rim top inside corner portion is formed to be larger than the rounding of the rim top outside corner portion. Therefore when wiping clean the rim portion, with the user's own hand placed from the rim portion top surface to the inside wall so as to follow the rounding of the top inside corner portion, the rim portion top surface, the rim top inside corner portion, and the inside wall can be efficiently cleaned. In addition, because cleaning can be performed while applying a relatively uniform force from the rim portion top surface to the rim top inside corner portion and inside wall, the user can easily impart a relatively strong force to the entirety of the rim portion to be wiped clean, so that cleaning performance can be improved.

In the present invention, the bottom end of the rim top inside corner portion is preferably placed above spout portion.

In the invention thus constituted, flush water spouted from the spout portion circulates in a region below the bottom end of the rim top inside corner portion, therefore splashing of flush water beyond the rim top inside corner portion can be prevented. Also, because flush water is circulated along a region below the bottom end of the rim top inside corner portion in this manner, the width of the rim top inside corner portion can be made relatively large.

In the present invention the ratio of the radius of the arc forming the rim top outside corner portion to the radius of the arc forming the rim top inside corner portion is preferably within a range of 1:2 to 1:5.

In the invention thus constituted, the radius of the arc forming the rim top inside corner portion is formed to be an arc easily grasped by the bending of a user's hand. Therefore when wiping clean a rim portion, a user can easily place his or her hand so as to follow the arc shape forming the rim top inside corner portion.

In the present invention the rim portion is preferably formed so that at least a part of its inside wall overhangs toward the inside.

In the invention thus constituted, persons such as installers or manufacturers can easily carry the toilet by grabbing onto the toilet with their hands placed on the rim formed with this overhanging shape.

In the present invention the spout portion is preferably formed to spout water forward from the front region of the bowl portion, thereby forming a swirling flow which flows from the front end toward the rear of the bowl portion.

In the invention thus constituted, the spouting port can form a swirl flow flowing from the front end of the bowl portion toward the rear, so that the bowl portion can be sufficiently flushed while conserving water.

In the present invention, the top portion of the rim portion is preferably formed to overhang toward the inside.

In the invention thus constituted, in the area from the bowl portion spout portion to the front side, where flush water spouted from the spout portion can easily splash beyond the rim portion to outside the toilet, the top portion of the rim portion is formed to overhang toward the inside, therefore flush water can be prevented from splashing outside the toilet.

In the present invention, the flush toilet is preferably a flush toilet for discharging waste by flushing the toilet using flush water supplied by a water utility direct-pressure supply apparatus, which makes direct use of the utility supply pressure from the flush water source.

In the invention thus constituted, the strength of the surge of flush water supplied from a utility direct pressure supply apparatus when spouting can be relatively constrained. It is difficult for flush water spouted from the spout portion to splash from the bowl portion past the rim portion, and the width of the rim top inside corner portion can be formed to be relatively large.

Advantageous Effects of Invention

In the present invention, when a user wipes off the rim portion with his or her own hand placed from the rim portion top surface to the inside wall so as to follow the rounding of the top inside corner portion, the rim portion top surface, the rim top inside corner portion, and the inside wall can be efficiently cleaned, and the user can easily impart a relatively strong force to the entirety of the rim portion to be wiped clean, so that cleaning performance can be improved.

DETAILED DESCRIPTION

Below, referring to the attached drawings, we discuss the constitution of a flush toilet according to an embodiment of the present invention.

Figure 1:
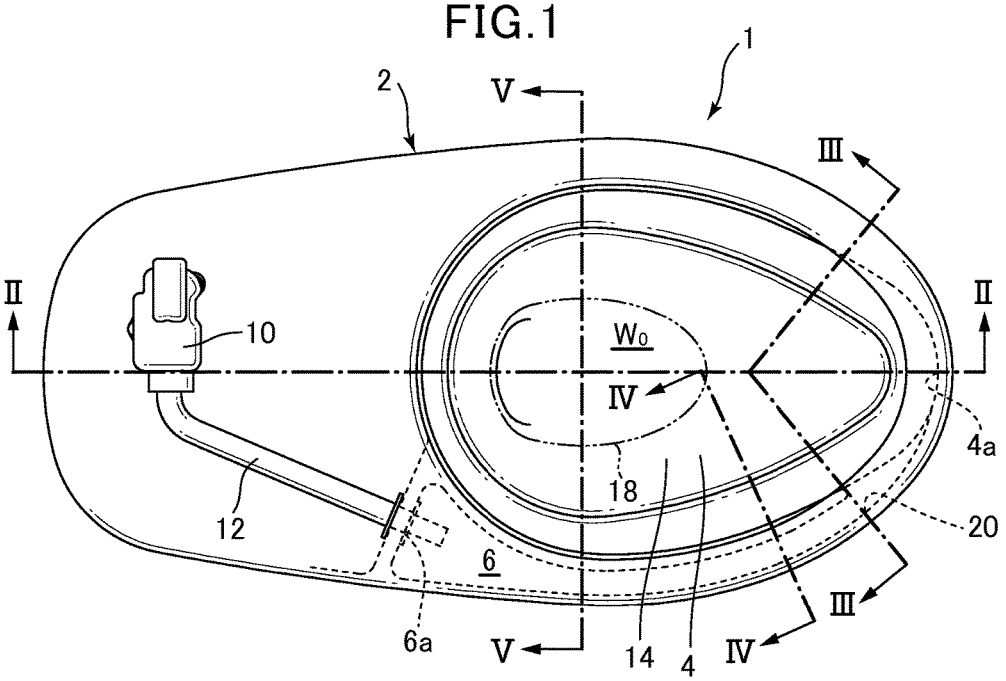
FIG. 1 is a summary plan view showing in outline form a toilet main body and water supply apparatus in a flush toilet according to an embodiment of the present invention.
Figure 2:
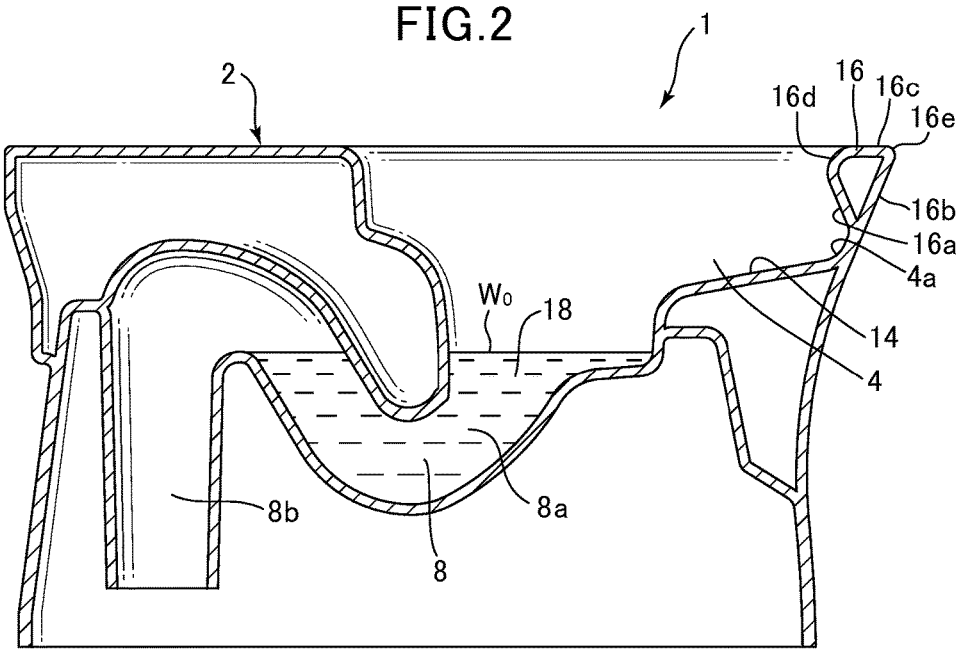
FIG. 2 is a center cross-section seen along line II-II in FIG. 1.

FIG. 1 is a summary plan view showing in outline form a toilet main body and water supply apparatus in a flush toilet according to an embodiment of the present invention; FIG. 2 is a center cross-section seen along line II-II in FIG. 1.

As shown in FIGS. 1 through 4, flush toilet 1 is what is known as a washdown-type toilet in which waste is pushed out by the flow effect caused by the dropping of water inside the bowl portion; this flush toilet 1 comprises a ceramic toilet main body 2; respectively formed on the front side of the top portion of this toilet main body 2 are: a bowl portion 4, a water conduit 6 at the top portion of the left side as seen from the front of the toilet main body 2, and a discharge trap pipe 8 communicating with the bowl portion 4 below the center rear side of the toilet main body 2. Note that the flush toilet 1 can also be applied to toilet types other than the washdown type, such as siphon toilets or siphon jet toilets. In addition, it can be applied to toilet types other than ceramic toilets, such as resin toilets, or to toilets using a distributor, etc.

The flush toilet 1 in the present embodiment is a utility direct pressure flush toilet in which flush water is directly supplied from a utility, comprising a utility direct pressure type of water supply apparatus 10 for supplying water using utility water pressure. This water supply apparatus 10 is constituted to supply flush water to the water conduit 6 through a water supply pipe 12 by opening and closing a flush valve. When applying a utility direct pressure water supply apparatus 10, the strength of the water surge when flush water is spouted from a spout port portion (spout portion) 20 described below can be relatively constrained compared to the use of a conventional gravity-type reservoir tank.

Note that the water supply apparatus 10 can also be applied in apparatuses other than utility direct pressure water supply apparatuses. For example, a water supply apparatus comprising a reservoir tank, being a gravity-type flush water supply means for storing and supplying flush water attached to the rear portion of this toilet main body 2, in which a discharge valve is provided on the reservoir tank, and flush water is supplied to the water conduit 6 on the toilet main body 2 by opening the discharge valve through the operation of an operating lever by a user, may also be applied to the flush toilet 1.

The bowl portion 4 comprises a waste receiving surface 14 formed in a bowl shape, and a rim portion 16, formed above and outside the entire perimeter of the bowl portion 4, thereby forming the top edge of the toilet. A pool portion 18 is also formed at the bottom of the bowl portion 4. A reservoir surface W0 at the position where flush water accumulates after each flush is formed on this pool portion 18. An inlet 8*a* on the discharge trap pipe 8 described above is opened at the bottom of this pool portion 18, and the bottom end of descending path 8*b* on the discharge trap pipe 8 is connected to a discharge pipe (not shown) through an under-floor discharge socket (not shown).

Note that in the flush toilet 1 of the present embodiment we are explaining a floor discharge-type of toilet in which the bottom end of the descending path 8*b* of the discharge trap pipe 8 is connected to a floor discharge pipe (not shown) as one example, but the invention is not limited thereto, and may also be applied to over-floor discharge type toilets in which an end of the descending path 8*b* is connected to a discharge pipe over a floor, disposed on the rear wall side of the flush toilet.

The water conduit 6 extends from an inlet portion 6*a* connected to a water supply pipe 12 extending from the water supply apparatus 10, and communicates with a forward-opening spout port portion 20 in the front area on the left of the toilet. The spout port portion 20 spouts flush water from the front area of the bowl portion 4 forward, forming a flow toward the front end of the bowl portion 4, and also forming a flow which turns back from the front end 4*a* of the bowl portion 4 toward the rear side.

Flush water supplied from the water supply apparatus 10 is spouted from the water supply pipe 12 through the water conduit 6 onto the surface going from the spout port portion 20 between the rim portion 16 and the waste receiving surface 14, and is spouted in the forward direction of the toilet onto the inside perimeter wall surface (inside wall) 16*a* of the rim portion 16 so that a swirling flow is formed; this circulating flow forms a descending flow as it swirls from the inside perimeter wall surface 16*a* of the rim portion 16 on the waste receiving surface 14 in the direction of the pool portion 18.

Next, referring to FIGS. 1 through 5, we describe the aforementioned rim portion 16 in detail.

Figure 3:
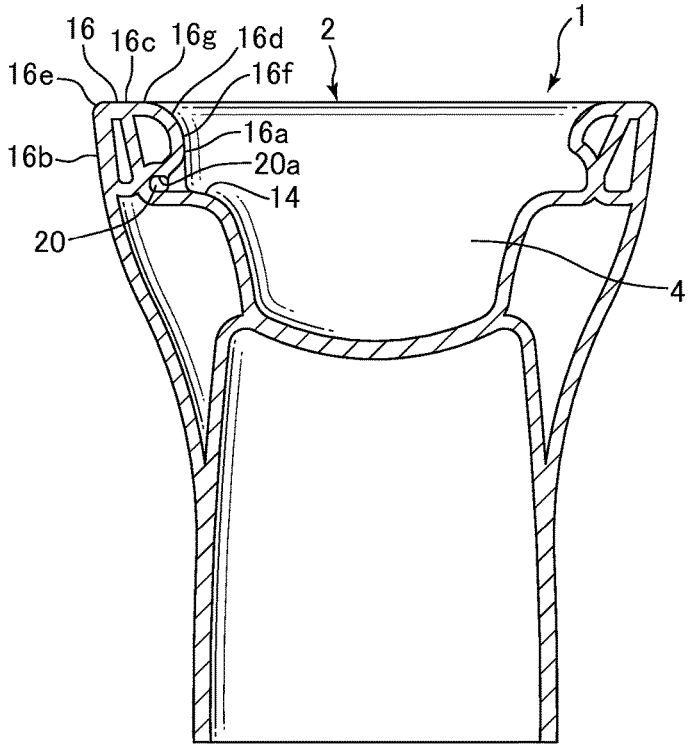
FIG. 3 is a cross-section seen along line III-III in FIG. 1.
Figure 4:
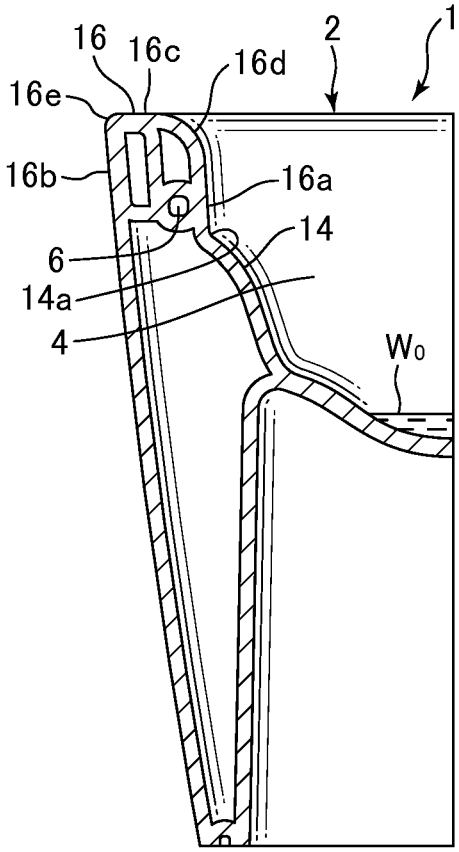
FIG. 4 is a cross-section seen along line IV-IV in FIG. 1.
Figure 5:
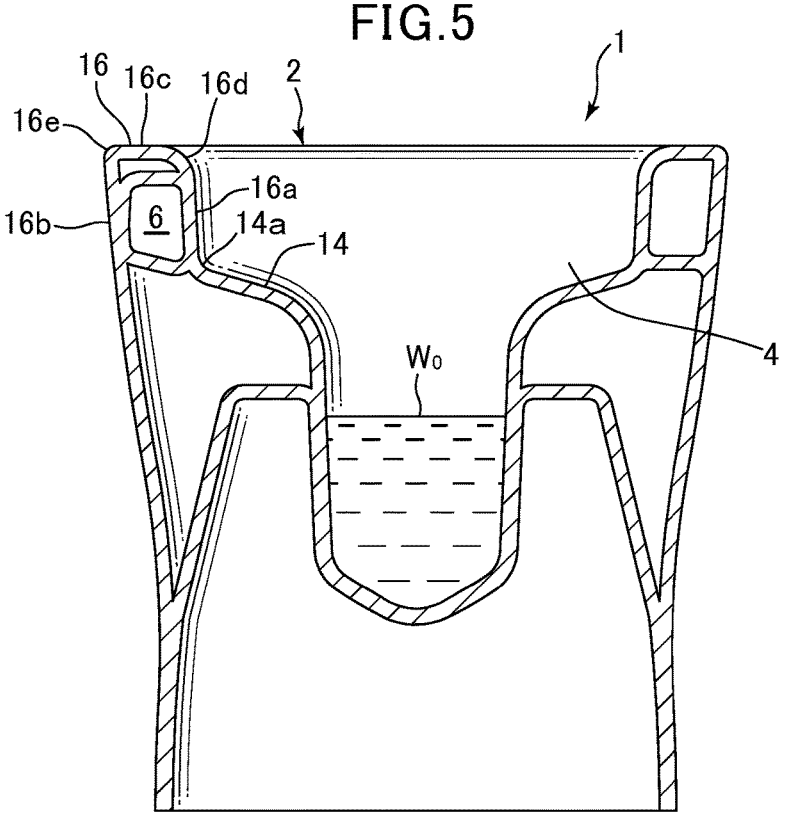
FIG. 5 is a cross-section seen along line V-V in FIG. 1.

FIG. 3 is a cross-section seen along line III-III in FIG. 1; FIG. 4 is a cross-section seen along line IV-IV in FIG. 1; FIG. 5 is a cross-section seen along line V-V in FIG. 1.

The rim portion 16 comprises: an inside perimeter wall surface 16*a* forming the innermost perimeter surface of the rim portion 16 and rising from the top edge 14*a* of the waste receiving surface 14 to the peak of the toilet main body 2; an outside perimeter wall surface (outside wall) 16*b* formed in a vertical wall shape so as to rise to a peak on the outside surface of the toilet main body 2; a rim top surface portion 16*c* forming the top surface of the rim portion 16; a rim top inside corner portion 16*d* forming the edge on the inside of the top portion of the rim portion 16 (the waste receiving surface 14 side) between the rim top surface portion 16*c* and the inside perimeter wall surface 16*a;* and a rim top outside corner portion 16*e* forming the edge on the outside of the top portion of the rim portion 16 (outside of the toilet main body 2) between the rim top surface portion 16*c* and the outside perimeter wall surface 16*b*.

The inside perimeter wall surface 16*a* is formed along the entire perimeter on the inside of the rim portion 16. The inside perimeter wall surface 16*a* may also be formed to rise essentially vertically, or may be formed to slope toward the inside as the surface rises from bottom to the top. I.e., in all or a portion of the perimeter of the rim portion 16, at least a part of the inside wall inside perimeter wall surface 16*a* can be formed so that at least a part of its inside wall forms a shape which overhangs toward the inside.

It is also acceptable for the rim portion 16 to form a shape overhanging toward the inside in all or part of the perimeter of the rim portion 16, in a shape combining the inside perimeter wall surface 16*a* and the rim top inside corner portion 16*d*. In particular, on the front side from the spout port portion 20 of the bowl portion 4, the inside perimeter wall surface 16*a* top portion and the rim top inside corner portion 16*d* of the rim portion 16 are formed in a shape which overhangs toward the inside of the bowl portion 4.

Also, using a shape combining the inside perimeter wall surface 16*a* and the rim top inside corner portion 16*d*, the rim portion 16 is formed so that on the front side of the bowl portion 4 spout port portion 20, the top portion is formed into a shape overhanging toward the inside. In the front-side region starting from the bowl portion 4 spout port portion 20, the direction of flush water is changed from forward facing, with a high surge of flush water spouted from the spout port portion 20, making it an area where splashing can generally occur easily, but in this area flush water can be prevented from splashing outside the toilet by the overhang shape of the rim portion 16.

The rim top surface portion 16*c* forms a flat surface extending horizontally and a peak surface on the toilet main body 2. Attempting to clean the rim portion 16 of toilet main body requires that fingers be bent to clean the rim top inside corner portion and the inside perimeter wall surface 16*a*, with the user's palm, etc. placed so as to horizontally follow this rim top surface portion 16*c*. Note that the rim top surface portion 16*c* is not limited to a horizontal surface, and may also be formed as a sloped surface rising or falling toward the bowl portion 4. The rim top surface portion 16*c* may also be formed as a curved surface. In addition, the rim top surface portion 16*c* may be formed as part of a curved surface extending to the outside of the outside end of the rim top inside corner portion 16*d*, or the rim top surface portion 16*c* may be formed as part of a curved surface extending to the inside of the inside end of the rim top outside corner portion 16*e*. For example, if the rim top surface portion 16*c* is formed as part of the rim top inside corner portion 16*d*, the outside end of the rim top inside corner portion 16*d* and the inside end of the rim top outside corner portion 16*e* can be relatively smoothly connected to form the top surface of the rim portion 16.

The rim top inside corner portion 16*d* forms a curved portion smoothly linking the horizontally-oriented rim top surface portion 16*c* and the vertically-oriented inside perimeter wall surface 16*a*. The rim top inside corner portion 16*d* forms an outward projecting arc. In other words, it forms an arc shape which connects the rim top surface portion 16*c* and the inside perimeter wall surface 16*a*. The rim top inside corner portion 16*d* is formed into an arc shape, in which the slope of the tangent to the surface thereof continuously changes according to position. Therefore when a user places his or her own hand so as to fit the rim top inside corner portion 16*d*, the occurrence of open space between the user's hand and the surface of the rim top inside corner portion 16*d* can be constrained, so that the hand can be naturally positioned to follow along the curved surface in its entirety. Note that the rim top inside corner portion 16*d* may also be formed by a curved surface of another shape to fit the way in which a human hand bends.

Note that placement by the above-described user of his or her hand so as to fit the rim top inside corner portion 16*d* includes not only fitting of the entire hand, but also fitting of the palm or fingers only. In addition, placement by the user of his or her hand so as to fit the rim top inside corner portion 16*d* includes cases in which the user fits his or her hand to the rim top inside corner portion 16*d* mediated by a cleaning cloth or paper such as toilet paper, etc. used for cleaning the toilet, etc. Also, placement by the user of his or her hand so as to fit the rim top inside corner portion 16*d* includes cases in which the user wears gloves when fitting his or her hand to the rim top inside corner portion mediated by a cleaning cloth or the like.

Seen in top view, at the center in the left-right direction of the toilet main body 2 a waste receiving surface 14 is disposed to form a descending curved surface while curving at the center, and the rim top inside corner portion, similarly forming a descending curved surface, is disposed on the outer perimeter side of the waste receiving surface 14. Therefore seen from the top surface, it is possible to convey the impression to a user that the rim top inside corner portion 16*d*, with a curved surface similar to the waste receiving surface 14, gradually descending toward the inside, continuously forms the outside curved surface of the waste receiving surface 14. I.e., the user receives the impression that the waste receiving surface 14 still further expands to the outside of the rim top inside corner portion 16*d*. For example, when a male user urinates while standing in front of the toilet main body 2, worries that the urine may go outside the waste receiving surface 14 can be alleviated by conveying the impression to the user that the waste receiving surface 14 spreads out widely, thereby reassuring the user that he may urinate without concern. Moreover, even in cases where, for example, a user uses a toilet while seated on a toilet seat (not shown) on the toilet main body 2, conveying to the user the impression that the waste receiving surface 14 is wide before he or she lowers the toilet seat (not shown) onto the toilet main body 2 can diminish apprehension that waste will miss the waste receiving surface, allowing the user to defecate without concern.

As shown in FIG. 3, the bottom end 16*f* of the rim top inside corner portion 16*d* is placed above the spout port portion 20. More specifically, the bottom end 16*f* of the rim top inside corner portion 16*d* is placed above the peak portion 20*a* of the spout port portion 20. In other words, the inside perimeter wall surface 16*a* is formed up to a height which is about the peak portion 20*a* of the spout port portion 20. Therefore the spout port portion 20 spouts flush water so that it contacts the downstream inside perimeter wall surface 16*a* in its vicinity.

A rim top inside corner portion 16*d* of the type described above is formed in a relatively gradual arc shape and with a relatively large left-right width. The left-right width between the top end 16*g* and bottom end 16*f* of the rim top inside corner portion 16*d* is formed to be larger than the left-right width of the opening on the spout port portion 20. Because the bottom end 16*f* of the rim top inside corner portion 16*d* is placed above the spout port portion 20, the width in the lateral direction of the rim top inside corner portion 16*d* can be made relatively large, and the rim top inside corner portion 16*d* can be formed so as to slope downward on the inside along a large diameter gradual arc.

The rim top outside corner portion 16*e* forms a curved portion smoothly linking the horizontally-oriented rim top surface portion 16*c* and the vertically-oriented outside perimeter wall surface 16*b*. The rim top outside corner portion 16*e* forms an outward and upward projecting arc. Stated differently, it forms an arc shape which connects the rim top surface portion 16*c* and the outside perimeter wall surface 16*b*.

The rim top outside corner portion 16*e* is formed by an arc with a radius of 5 mm to 8 mm when seen in vertical section. The rim top inside corner portion 16*d* is formed by an arc with a radius of 10 mm to 25 mm when seen in vertical section. Therefore the ratio of the radius of the arc forming the rim top outside corner portion 16*e* to the radius of the arc forming the rim top inside corner portion 16*d* is within a range of 1:2 to 1:5. The width in the lateral direction of the rim top inside corner portion 16*d* (the direction facing from the inside direction to the outside direction of the toilet main body) is formed to be larger than the width in the lateral direction of the rim top outside corner portion 16*e* (the direction facing from the inside direction to the outside direction of the toilet main body). The rim top inside corner portion 16*d* is formed by an arc having a radius of 10 mm to 25 mm, therefore when a user places his or her hand on the rim top inside corner portion 16*d*, he or she is able to do so naturally along the rim top inside corner portion 16*d*, and the shape is one which can be easily gripped without the occurrence of a relatively large space between the hand and the rim portion 16.

Note that in the rim top outside corner portion 16*e* it is also acceptable for the rounding between the rim top surface portion 16*c* and the outside perimeter wall surface 16*b* to vary continuously. I.e., in the rim top outside corner portion 16*e* it is also acceptable for the curvature radius of the surface between the rim top surface portion 16*c* and the outside perimeter wall surface 16*b* to vary continuously. The relatively small rounding of the rim top outside corner portion 16*e* means that of the curved surfaces between the rim top surface portion 16*c* and the outside perimeter wall surface 16*b*, the minimum curvature radius is a relatively small curvature radius such as, for example, 5 mm to 8 mm.

Also, the rim top inside corner portion 16*d* may be formed by a continuously varying curved surface so as to impart a rounding between the rim top surface portion 16*c* and the inside perimeter wall surface 16*a*. In other words, in the rim top inside corner portion 16*d* it is also acceptable for the curvature radius of the surface between the rim top surface portion 16*c* and the inside perimeter wall surface 16*a* to vary continuously. The relatively large rounding of the rim top inside corner portion 16*d* means that of the curved surfaces between the rim top surface portion 16*c* and the inside perimeter wall surface 16*a*, the minimum curvature radius is a relatively large curvature radius such as, for example, 10 mm to 25 mm.

Therefore the rounding of the rim top inside corner portion 16*d* is formed to be larger than the rounding of the rim top outside corner portion 16*e*, and the minimum curvature radius of the rim top inside corner portion 16*d* curved surface is formed to be larger than the minimum curvature radius of the rim top outside corner portion 16*e* curved surface.

The rim top inside corner portion 16*d* may also be formed to include a relatively flat surface in part of the surface between the rim top surface portion 16*c* and the inside perimeter wall surface 16*a*, with a surface shape bent so as to be rounded over its entirety.

Also, as described above, the inside perimeter wall surface 16*a* and rim top inside corner portion 16*d* are formed so as to overhang inwardly in at least a part, therefore the rim portion 16 is easy for an installer or manufacturer, etc. to grip by lifting upward by placing hands on the inside of the overhanging shape in the rim portion 16. Therefore when an installer or manufacturer etc. carries the toilet, the load to be lifted upward is more easily imparted to the rim portion 16 with the tips of the fingers gripping the bottom side of the rim top inside corner portion 16*d* by placing of the hands on the rim portion 16, which is formed into an overhanging shape, thereby easing transport of the toilet.

Figure 6:
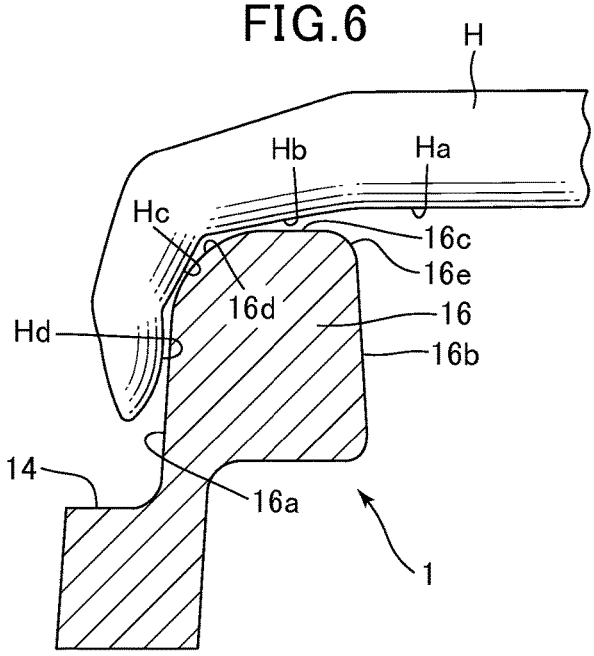
FIG. 6 is a diagram in which a user's hand is placed so as to follow the rim top inside corner portion of a flush toilet according to an embodiment of the present invention.
Figure 7:
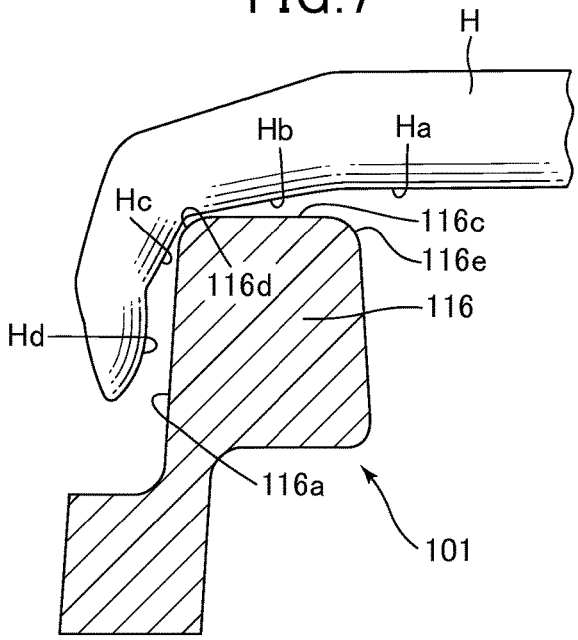
FIG. 7: A diagram showing a user's hand placed on the rim top inside corner portion of a conventional flush toilet.

Next, referring to FIGS. 6 and 7, we explain details of the state in which the above-described user seeks to clean the rim portion 16.

FIG. 6 is a diagram showing the state in which a user's hand is placed so as to follow a part of a rim top inside corner portion on a flush toilet according to an embodiment of the present invention; FIG. 7 is a diagram showing a user's hand placed on the rim top inside corner portion of a conventional flush toilet. Our explanation uses the reference symbol H for the user's hand.

In the present embodiment of the invention, when a user seeks to clean the rim portion 16, the user performs the cleaning with the palm Ha and/or palm-side finger parts Hb of hand H contacting the rim top surface portion 16*c*, thereby cleaning the inside perimeter wall surface 16*a* side on the finger tip Hd side. Here the rim top surface portion 16*c* forms a generally horizontal plane, and the inside perimeter wall surface 16*a* forms a generally vertical wall surface, therefore the user bends his or her finger joints to clean the inside perimeter wall surface 16*a* side. At this point, the rim top inside corner portion 16*d* forms a relatively large diameter arc, so the bent portions of the fingers (e.g., Hc, Hd) can be mildly bent, and the bent parts of fingers (e.g., Hc) can be fit to the arc of the rim top inside corner portion 16*d*. Therefore the user can, for example, place the joint-side palm-side part Hb of his or her hand H in contact with the rim top surface portion 16*c*, place the second joint part He in contact with the rim top inside corner portion 16*d*, place the fingertip part Hd in contact with the inside perimeter wall surface 16*a*, and can efficiently clean the rim top surface portion 16*c*, the rim top inside corner portion 16*d* and the inside perimeter wall surface 16*a*. In addition, the user can place the rim top surface portion 16*c*, the rim top inside corner portion 16*d*, and the inside perimeter wall surface 16*a* in a contacting state without excessively bending the hand H, therefore the user can easily impart the force necessary for cleaning to the hand H. Hence cleanability of the rim top surface portion 16*c*, the rim top inside corner portion 16*d*, and the inside perimeter wall surface 16*a* can be improved.

Also, when a user seeks to clean the inside perimeter wall surface 16*a* from the rim top surface portion 16*c* side past the rim top inside corner portion 16*d*, the circumstance in which cleaning of the rim top inside corner portion 16*d* fails due to an inability to impart sufficient force to the rim top inside corner portion 16*d*, thereby requiring further effort for cleaning, can be constrained from occurring.

In contrast, in a conventional flush toilet 101, if a user is attempting to clean a rim portion 116, then when the user cleans with the palm Ha of his or her hand H and/or the palm-side portion of fingers Hb disposed so as to contact the rim top surface portion 116*c*, the formation of the rim top inside corner portion 116*d* in a relatively small-radius arc (an arc with approximately the same radius as the rim top outside corner portion 116*e*) creates a state whereby the bending parts of the finger, such as the second joint portion He of the finger, cannot be placed in a way which fits the arc of the rim top inside corner portion 116*d*. I.e., the second joint part He of the user's hand H is separated from the rim top inside corner portion 116*d*, and the finger tip portion Hd is separated from the inside perimeter wall surface 116*a*.

To move from this state to one in which fingertip portion Hd is contacting the inside perimeter wall surface 116*a* requires a slight lifting up of palm Ha and palm-side finger part Hb so as to separate from the rim top surface portion 116*c*.

Also, in a conventional flush toilet 101, due to limitations in the range of mobility of human hand joints, even if the hand is excessively bent so as to bring the joint-side part Hb of the user's hand H and the rim top surface portion 116*c* into contact, and to bring the second finger joint portion Hc and a part of the top portion of the rim top inside corner portion 116*d* into contact, it would still not only not be possible for the second finger joint part Hc and the lower part of the rim top inside corner portion 116*d* to make contact, but it would also not be possible to achieve contact between the fingertip part Hd and the inside perimeter wall surface 116*a*. Therefore problems occur in the cleaning of the rim top inside corner portion 116*d* and the inside perimeter wall surface 116*a*, requiring yet further effort for cleaning.

In addition, in a conventional flush toilet 101, due to limitations in the range of mobility in human hand joints, even if the hand were excessively bent so as to bring the joint-side part Hb of the user's hand H and the rim top surface portion 116*c* into contact, and to bring the fingertip part Hd and the inside perimeter wall surface 116*a* into contact, it is not possible to simultaneously achieve a state in which the second finger joint portion Hc and the rim top inside corner portion 116*d* are contacting. Therefore problems occur in the cleaning of the rim top inside corner portion 116*d*, requiring yet further effort for cleaning Moreover, because it is not possible to simultaneously contact the rim top surface portion 116*c* and a part of other curved surfaces without excessive bending of the user's hand H, it is difficult for the user to impart sufficient force to hand H for cleaning Therefore problems occur in the cleanability of the rim top surface portion 116*c*, the rim top inside corner portion 116*d*, and the inside perimeter wall surface 116*a*.

In a flush toilet according to the above-described embodiment of the invention, in at least a part of the entire perimeter of the rim portion 16 the roundness of the rim top inside corner portion 16*d* is formed to be larger than the roundness of the rim top outside corner portion 16*e*. As a result, when a user wipes clean the rim portion 16, the rim top surface portion 16*c*, rim top inside corner portion 16*d*, and inside perimeter wall surface 16*a* of the rim portion 16 can be efficiently cleaned in a state whereby the user's own hand is placed in an area starting from the top surface of the rim portion 16, following the roundness of the rim top inside corner portion 16*d* up to the inside perimeter wall surface 16*a*. Also, because cleaning can be performed while applying a relatively uniform force from the rim portion 16 top surface portion 16*c* to the rim top inside corner portion 16*d* and inside perimeter wall 16*a*, the user can easily impart a relatively strong force to the entirety of the rim portion to be wiped clean, so that cleaning performance can be improved.

The roundness of the rim top inside corner portion 16*d* is made larger than the roundness of the rim top outside corner portion 16*e*. Therefore the rim top inside corner portion 16*d* formed above and outside the waste receiving surface 14 can give the user the impression that the waste receiving surface 14 expands further toward the outside, so that the bowl portion 4 appears relatively larger than conventional toilets, thereby imparting to the user the reassurance that urine can be easily passed into the bowl portion 4 during use.

Also, when using a flush toilet according to the above-described embodiment of the invention, flush water spouted from the spout port portion 20 is swirled over an area below the bottom end 16*f* of the rim top inside corner portion 16*d*, therefore flush water can be prevented from exceeding the rim top inside corner portion 16*d* and splashing outside the toilet. Also, because flush water is circulated along a region below the bottom end 16*f* of the rim top inside corner portion 16*d* in this manner, the width of the rim top inside corner portion 16*d* can be made relatively large. However, the present invention is not limited to such embodiments, and a similar effect may be obtained, for example, if the position of the bottom and of the rim top inside corner portion is higher than the maximum height to which the flesh water spouted from the spout port portion 20 is anticipated to reach. For example, if flush water spouted from the spout port portion 20 only reaches the height at the center of the spout port portion 20, it is sufficient to place the bottom end 16*f* of the rim top inside corner portion 16*d* at a position higher than the height of the center of the spout port portion 20.

Also, using the flush toilet according to the above-described embodiment of the present invention, the radius of the arc forming the rim top inside corner portion 16*d* is formed to be a radius which can be easily gripped by a user bending his or her hand. Hence when wiping clean a rim portion 16, a user can easily place his or her hand so as to follow the arc shape forming the rim top inside corner portion 16*d*.

Also, using the flush toilet according to the above-described embodiment of the present invention, when an installer or manufacturer, etc. performs an installation, or carries the toilet during manufacturing, etc., the toilet can be easily transported with the hand in a gripping state by placement of the hand on the rim portion 16 formed by the overhanging shape.

In addition, using the flush toilet according to the above-described embodiment of the present invention, the spout port portion 20 can form a swirling flow which flows from the front end toward the back end of the bowl portion 4, so that the bowl portion 4 can be sufficiently cleaned while conserving water.

Also, using the flush toilet according to the above-described embodiment of the present invention, in the area from the bowl portion 4 spout port portion 20 forward, where flush water can easily splash outside the toilet, flush water spouted from the spout port portion 20 is prevented from splashing outside the toilet by forming the rim portion 16 top portion into a shape which overhangs toward the inside.

Also, using the flush toilet according to the above-described embodiment of the present invention, flush water supplied from the utility direct pressure-type water supply apparatus 10 has a relatively constrained water surge strength during spouting. It is therefore difficult for flush water spouted from the spout portion 20 to splash from the bowl portion 4 past the rim portion 16, and the width of the rim top inside corner portion 16*d* can be formed to be relatively large.

What is claimed is:

1. A flush toilet for discharging waste by flushing the toilet with flush water supplied from a flush water source, having:

a bowl portion comprising a bowl-shaped waste receiving surface and a rim portion formed above and outside the waste receiving surface to form a top edge of the toilet;

a discharge path for discharging waste, the inlet of which is connected underneath this bowl portion;

a spout portion for spouting flush water to the bowl portion and forming a swirling flow; and aa water conduit for supplying flush water to the spout portion;

wherein the rim portion comprises:

a rim top inside corner portion extending from a top surface portion to an inside wall of the rim portion and forming an upward projecting surface curved from a top end of the rim top inside corner portion to a bottom end of the rim top inside corner portion;

a rim top outside corner portion extending from the top surface portion to an outside wall of the rim portion and forming an upward projecting surface curved from a top end of the rim top outside corner portion to a bottom end of the rim top outside corner portion;

in at least part of the entire perimeter of the rim portion, a left-right width from the top end of the rim top inside corner portion to the bottom end of the rim top inside corner portion is larger than a left-right width from the top end of the rim top outside corner portion to the bottom end of the rim top outside corner portion and is larger than a left-right width of an opening on the spout portion; and wherein the bottom end of the rim top inside corner portion is placed above the spout portion;

wherein the inside wall is formed so as to extend straightly toward a lower side from the bottom end of the rim top inside corner portion.

2. The flush toilet of claim 1, wherein the ratio of the radius of the arc forming the rim top outside corner portion to the radius of the arc forming the rim top inside corner portion is within a range of 1:2 to 1:5.

3. The flush toilet of claim 1, wherein the rim portion is formed so that at least a part of the inner wall has a shape which overhangs toward the inside.

4. The flush toilet of claim 1, wherein the spout portion is formed to spout water forward from the front region of the bowl portion, thereby forming a swirling flow which flows from the front end toward the rear of the bowl portion.

5. The flush toilet of claim 1, wherein the top portion of the rim portion is formed to overhang toward the inside from the spout portion to the front side of the bowl portion.

6. The flush toilet of claim 1, being a flush toilet for discharging waste by flushing a toilet using flush water supplied by a water utility direct-pressure supply apparatus, which makes direct use of the utility supply pressure from the flush water source.

* * * * *